US007807930B1

(12) United States Patent
Hansen et al.

(10) Patent No.: US 7,807,930 B1
(45) Date of Patent: Oct. 5, 2010

(54) HIGH-VOLTAGE FEED-THROUGH BUSHING WITH INTERNAL AND EXTERNAL ELECTRIC FIELD GRADING ELEMENTS

(75) Inventors: Peder Meyer Hansen, San Diego, CA (US); Wendy Marie Massey, La Jolla, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 566 days.

(21) Appl. No.: 11/948,417

(22) Filed: Nov. 30, 2007

(51) Int. Cl.
*H01B 17/26* (2006.01)

(52) U.S. Cl. ..... 174/142; 174/137 R; 174/155; 174/152 R

(58) Field of Classification Search ..... 174/100, 174/137 B, 138 R, 138 D, 138 F, 142, 140 H, 174/148, 152 R, 152 G, 153 G, 154; 16/2.1, 16/2.2; 439/921
See application file for complete search history.

(56) References Cited

U.S. PATENT DOCUMENTS 2,859,271 A * 11/1958 Johnston et al. ..... 174/142
5,466,891 A * 11/1995 Freeman et al. ..... 174/142
6,218,627 B1 * 4/2001 Shindo et al. ..... 174/142
6,951,987 B1 10/2005 Hansen et al.
7,262,367 B2 * 8/2007 Donzel et al. ..... 174/142

OTHER PUBLICATIONS

S. Monga, R. S. Gorur, P. Hansen, W. Massey; Design Optimization of High Voltage Bushing Using Electric Field Computations; IEEE Transactions on Dielectrics and Electrical Insulation, vol. 13, No. 6; Dec. 2006.

* cited by examiner

*Primary Examiner*—Angel R Estrada
(74) *Attorney, Agent, or Firm*—Kyle Eppele; J. Eric Anderson

(57) ABSTRACT

A high-voltage (HV) bushing that comprises first and second sections, at least two internal grading elements, and at least two external grading elements. The first and second sections each have a HV end and a grounded end. The exterior of the first section is configured to be exposed to open air. One internal grading element is mounted to the HV end of the first section and another internal grading element is mounted to the grounded end of the first section. One of the external grading elements is mounted to the HV end of the first section and another external grading element is coupled to the grounded end of the first section. The internal grading elements and the external grading elements are each configured to moderate an electric field along the inner and outer surfaces of the HV bushing near the HV end and the grounded end of the first section.

20 Claims, 8 Drawing Sheets

HIGH-VOLTAGE FEED-THROUGH BUSHING WITH INTERNAL AND EXTERNAL ELECTRIC FIELD GRADING ELEMENTS

FEDERALLY-SPONSORED RESEARCH AND DEVELOPMENT

This invention (Navy Case No. 98038) is assigned to the United States Government and is available for licensing for commercial purposes. Licensing and technical inquiries may be directed to the Office of Research and Technical Applications, Space and Naval Warfare Systems Center, San Diego, Code 2112, San Diego, Calif., 92152; voice (619) 553-2778; email T2@spawar.navy.mil. Reference Navy Case Number 98038.

CROSS-REFERENCE TO RELATED PATENT

This application is related to U.S. Pat. No. 6,951,987 entitled "High Voltage Bushing," hereby incorporated by reference in its entirety for its teachings.

BACKGROUND OF THE INVENTION

Increasing the operating voltage of high-voltage, feed-through bushings where available real estate is limited can be challenging due to the risk of corona formation and flash-overs. Sustained corona and discharge activity can degrade high-voltage bushings, creating hazardous conditions. A need exists for an improved, high-voltage bushing.

BRIEF DESCRIPTION OF THE DRAWINGS

Throughout the several views, like elements are referenced using like references.

DETAILED DESCRIPTION OF EMBODIMENTS

Figure 1:
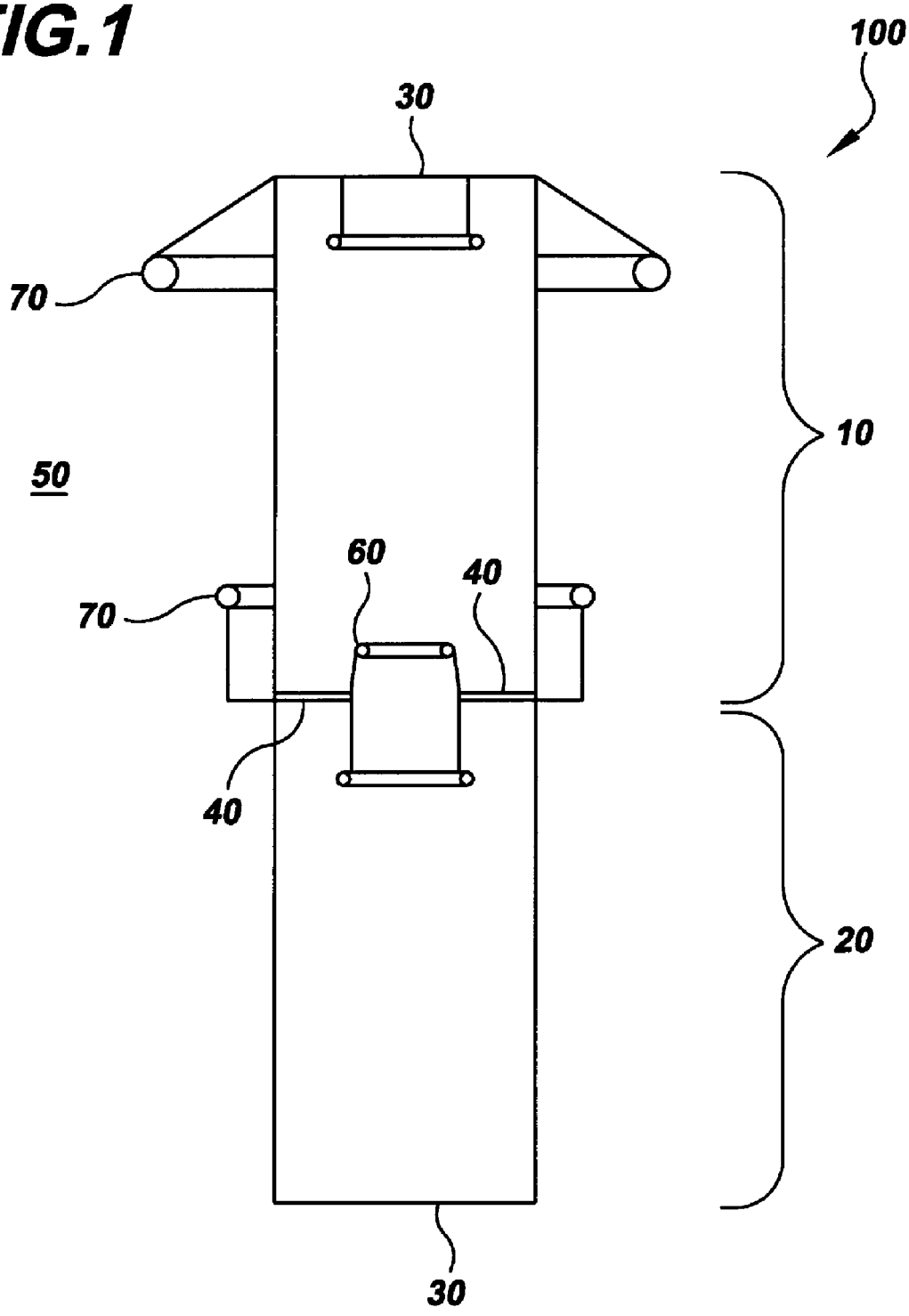
FIG. 1 shows a cross-sectional view of one embodiment of a high-voltage bushing with internal and external grading elements.

FIG. 1 is a cross-sectional view of a high-voltage (HV) bushing 100 that comprises first and second sections 10 and 20. The first and second sections 10 and 20 each have a HV end 30 and a grounded end 40. The exterior of the first section 10 is configured to be exposed to open air 50. The HV bushing 100 also comprises at least two internal grading elements 60 and at least two external grading elements 70. One of the internal grading elements 60 may be mounted to the HV end 30 of the first section 10, and one of the internal grading elements 60 may be coupled to the grounded end 40 of the first section 10. One of the external grading elements 70 may be mounted to the HV end 30 of the first section 10 and one of the external grading elements 70 may be coupled to the grounded end 40 of the first section 10. The internal grading elements 60 and the external grading elements 70 are each configured to moderate an electric field along the inner and outer surfaces of the HV bushing 100 near the HV end 30 and the grounded end 40 of the first section 10.

Figure 2:
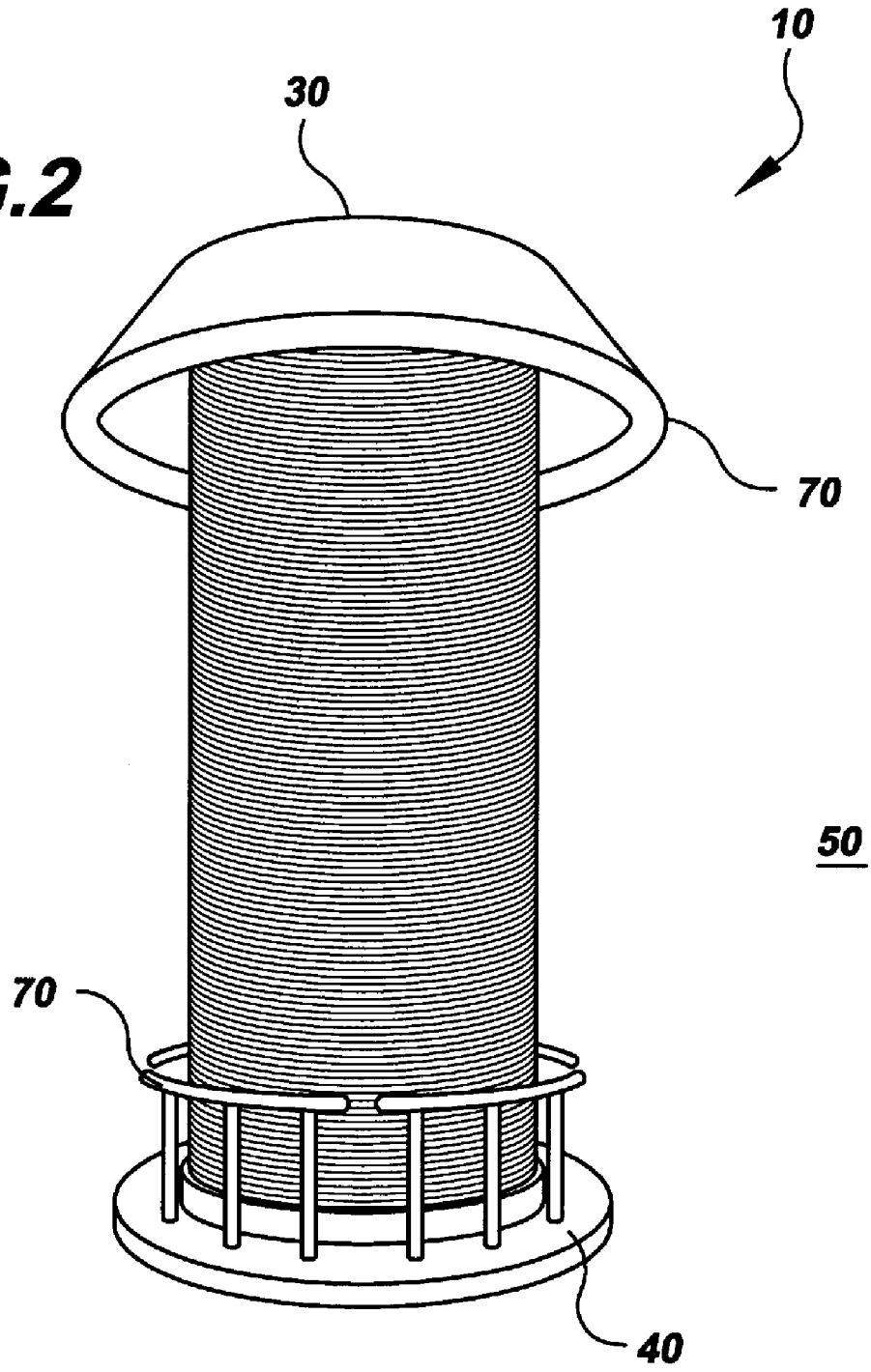
FIG. 2 shows a perspective view of a section of an embodiment of the high-voltage bushing.

FIG. 2 shows a perspective view of the exterior of the first section 10 of the HV bushing 100. The external grading elements 70 can also be seen in FIG. 2; one mounted to the HV end 30 and another mounted to the grounded end 40. The internal grading elements 60, being inside the HV bushing 100, are not visible in this view.

Figure 3:
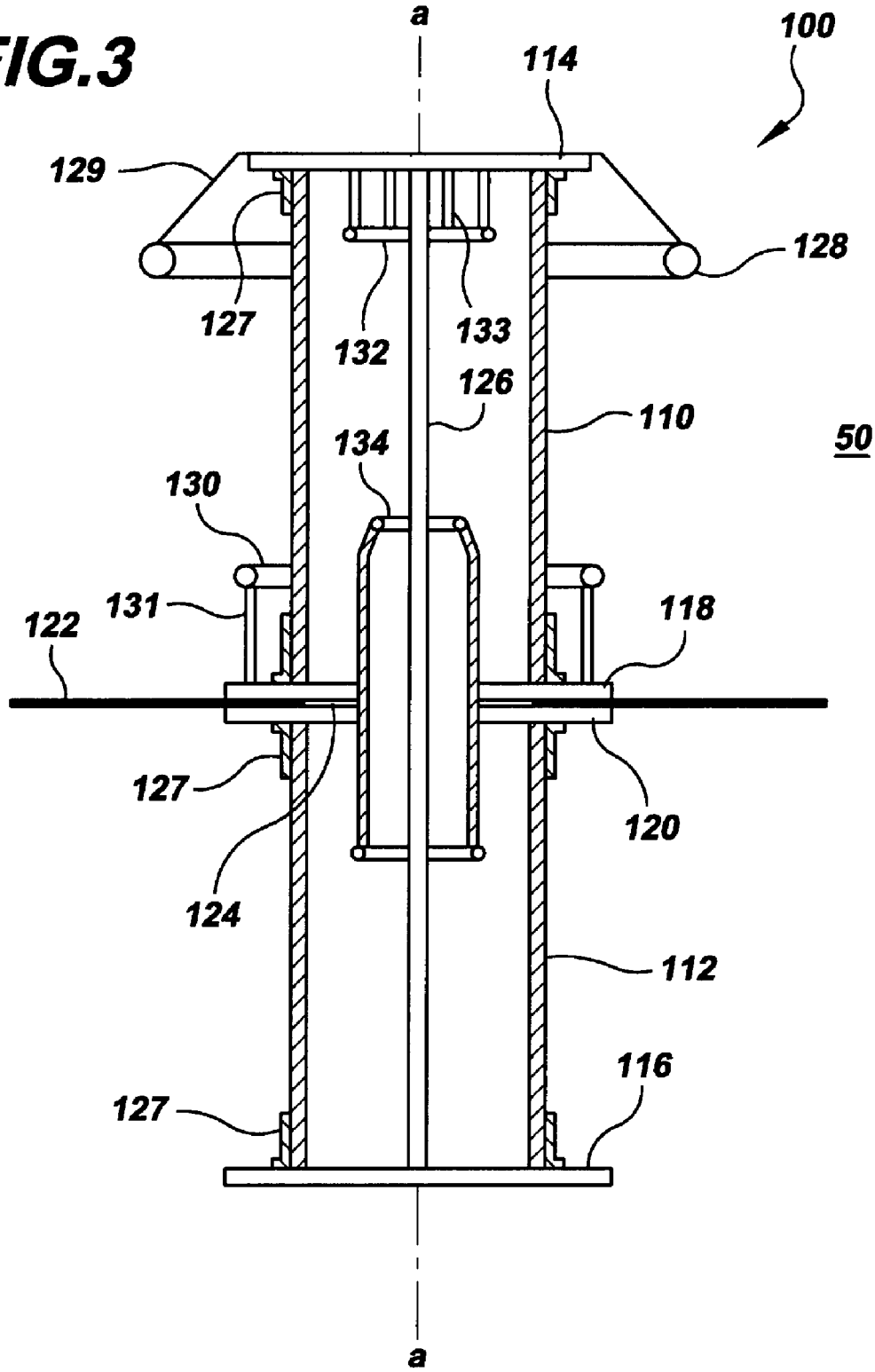
FIG. 3 shows a cross-sectional view of one embodiment of a high-voltage bushing mounted to a surface.

FIG. 3 shows a more detailed cross-sectional view of an embodiment of the HV bushing 100. In the embodiment shown in FIG. 3, the first and second sections 10 and 20 of the HV bushing 100 comprise first and second dielectric tubes 110 and 112 respectively. Also shown in FIG. 3 are first and second HV end-plates 114 and 116 that are coupled to the HV ends 30 of the first and second sections 10 and 20 respectively. First and second grounded end-plates 118 and 120 are also shown being coupled to the grounded ends 40 of the first and second sections 10 and 20 respectively. The first and second grounded end-plates 118 and 120 are configured to be mounted on opposite sides of a surface 122 such that the first and second dielectric tubes 110 and 112 are approximately coaxially aligned along axis a-a. The surface 122 may be any surface to which the first and second sections 10 and 20 may be mounted. Examples of the surface 122 include, but are not limited to, building walls, building roofs, ship decks, and ship hulls. The surface 122 may comprise an aperture 124 that is generally coaxially aligned with the first and second dielectric tubes 110 and 112. The HV bushing 100 is configured to enclose a center conductor 126 in a position that is generally coaxially aligned with the first and second dielectric tubes 110 and 112. The center conductor 126 may be any conductor of any shape that fits inside the HV bushing 100. For example, the center conductor 126 may be copper with a generally circular cross-section of approximately 10.16 centimeters (4 inches) in diameter.

FIG. 3 also shows each end of the first and second dielectric tubes 110 and 112 being terminated by a terminal flange 127. A terminal flange 127 may be mounted to each of the first HV end-plate 114 and the first grounded end-plate 118 such that the first dielectric tube 110 is disposed between the first HV end-plate 114 and the first grounded end-plate 120. Likewise, a terminal flange 127 may be mounted to each of the second HV end-plate 116 and the second grounded end-plate 120 such that the second dielectric tube 112 is disposed between the second HV end-plate 116 and the first grounded end-plate 120. In this embodiment, the internal and external grading elements 60 and 70 are configured to moderate an electric field at the junction of the terminal flanges 127 at either end of the first dielectric tube 110.

The first and second dielectric tubes 110 and 112 may be made of any insulating material, such as porcelain or composite materials. For example, the first and second dielectric tubes 110 and 112 may be made out of fiberglass covered with a silicone rubber material. In one embodiment, the HV bushing 100 may be sealed and pressurized with an insulating medium. Examples of suitable insulating mediums include, but are not limited to, sulfur hexafluoride ($SF_6$), nitrogen ($N_2$), and compressed air. The first and second HV end-plates 114 and 116 and the first and second grounded end-plates 118 and 120 may be made of any conductive material. Example materials of which the first and second HV end-plates may be made of include, but are not limited to, copper, steel, and aluminum.

In the embodiment of the HV bushing shown in FIG. 3, the external grading elements 70 (shown in FIG. 1) comprise an external corona ring 128 mounted to the first HV end-plate 114, and an external grading ring 130 mounted to the first grounded end-plate 118. The external corona ring 128 is configured to moderate an electric field outside the HV bushing 100 at the junction of the first dielectric tube 110, the first HV end-plate 114, and the open air 50. The external grading ring 130 is configured to reduce an electric field outside the HV bushing 100 at the junction of the first dielectric tube 110, the first grounded end-plate 118, and the open air 50. The internal grading elements 60 (shown in FIG. 1) comprise an internal grading ring 132 mounted to the first HV end-plate 114, and an electric field shaper 134 mounted to the first and second grounded end-plates 118 and 120. The internal grading ring 132 is configured to moderate an electric field inside the HV bushing 100 at the junction of the first dielectric tube 110, and the first HV end-plate 114. The electric field shaper 134 is configured to moderate an electric field inside the HV bushing 100 at the junction of the first dielectric tube 110, and the first grounded end-plate 118.

The external corona ring 128 is configured to moderate an electric field at the junction of the first dielectric tube 110, the first HV end-plate 114, and the open air 50. The external corona ring 128 may be made of any conductive material. For example, the external corona ring 128 may be fabricated out of aluminum. The external corona ring 128 may be hollow or solid. The external corona ring 128 may be mounted to the first HV end-plate 114 in any manner that allows the external corona ring 128 to moderate an electric field at the junction of the first dielectric tube 110, the first HV end-plate 114, and the open air 50. For example, the external corona ring 128 may be mounted to the first HV end-plate 114 with a continuous support structure 129, as shown in FIG. 3.

The external grading ring 130 is configured to moderate an electric field at the junction of the first dielectric tube 110, the first grounded end-plate 118, and the open air 50. The external grading ring 130 may be made of any conductive material. For example, the external grading ring 130 may be fabricated out of aluminum. The external grading ring 130 may be hollow or solid. The external grading ring 130 may be any size or shape and mounted to the first grounded end-plate 118 in any manner that allows the external grading ring 130 to moderate an electric field at the junction of the first dielectric tube 110, the first grounded end-plate 118, and the open air 50. For example, the external grading ring 130 may be mounted to the first grounded end-plate 118 with a series of support members 131, radially disposed from axis a-a, as shown in FIG. 3.

The internal grading ring 132 is configured to moderate an electric field at the junction of the first dielectric tube 110 and the first HV end-plate 114. The internal grading ring 132 may be made of any conductive material. For example, the internal grading ring 132 may be fabricated out of aluminum. The internal grading ring 132 may be hollow or solid. The internal grading ring 132 may any size or shape and be mounted to the first HV end-plate 114 in any manner that allows the internal grading ring 132 to moderate an electric field at the junction of the first dielectric tube 110 and the first HV end-plate 114. For example, the internal grading ring 132 may be mounted to the first HV end-plate 114 with a series of support members 133, as shown in FIG. 3.

The electric field shaper 134 is configured to moderate an electric field at the junction of the first dielectric tube 110 and the first grounded end-plate 118. The electric field shaper 134 may be made of any conductive material. For example, the electric field shaper 134 may be fabricated out of aluminum. The electric field shaper 134 may be hollow or solid. The electric field shaper 134 may be any size or shape and mounted to the first grounded end-plate 118 in any manner that allows the electric field shaper 134 to moderate an electric field at the junction of the first dielectric tube 110 and the first grounded end-plate 118. For example, the electric field shaper 134 may be generally cylindrical with open ends and aligned generally coaxially with axis a-a. The open end of the electric field shaper 134 closest to the first HV end-plate 114 may be necked-down, as shown in FIG. 3, so as to moderate the electric field inside the HV bushing 100 near the intersection of the first dielectric tube 110 and the first grounded end-plate 118. The electric field shaper may be mounted to the first grounded end-plate 118.

Figure 4:
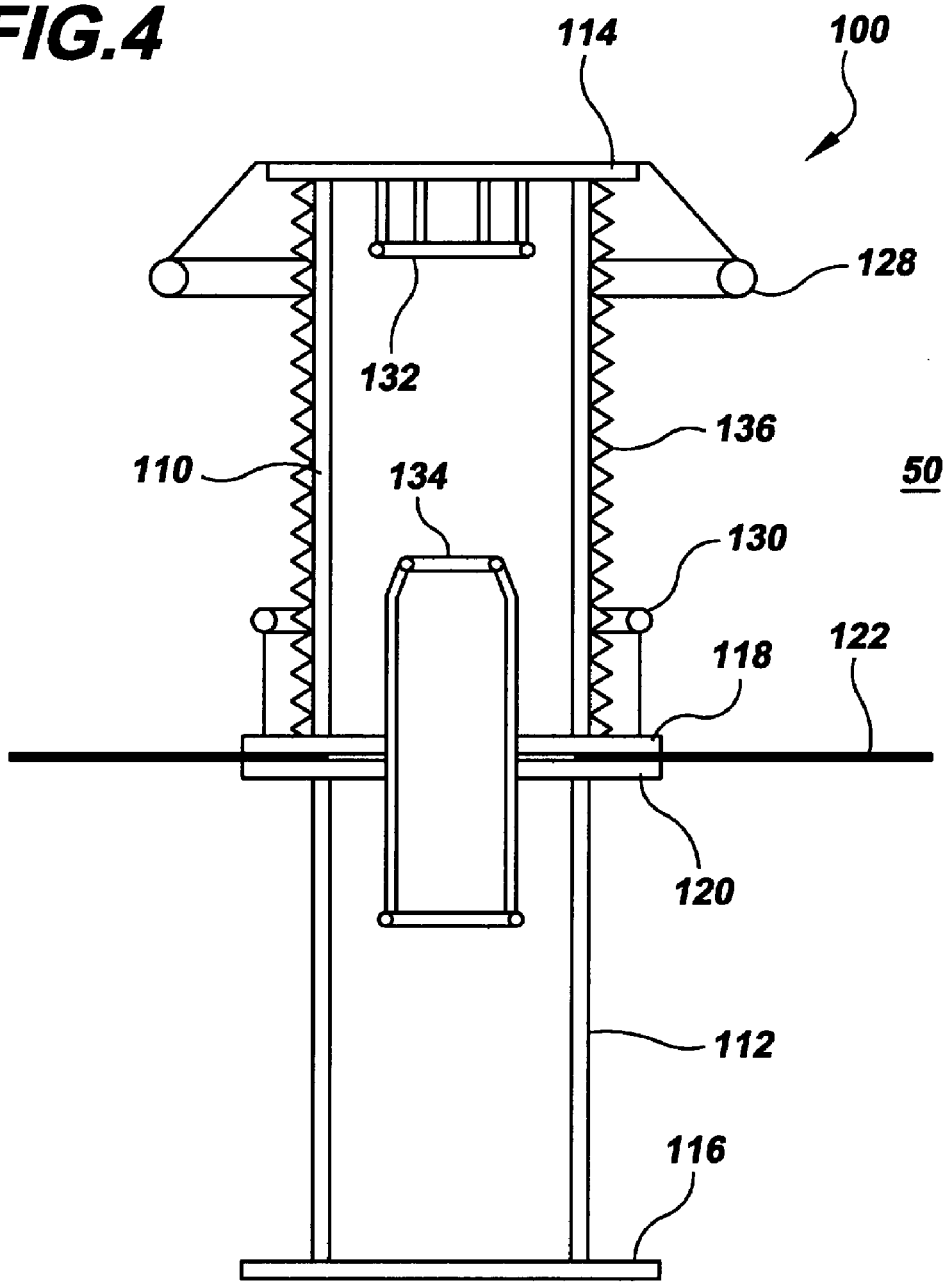
FIG. 4 shows a cross-sectional view of one embodiment of a high-voltage bushing with a shedding attached.

FIG. 4 shows an embodiment of the HV bushing 100 that further comprises a shedding 136 affixed to the exterior surface of the first dielectric tube 110. The shedding 136 serves to increase the electrical discharge path to ground of the HV bushing 100. The shedding 136 may be made of any insulating material. For example, the shedding 136 may be a silicone rubber coating.

Figure 5:
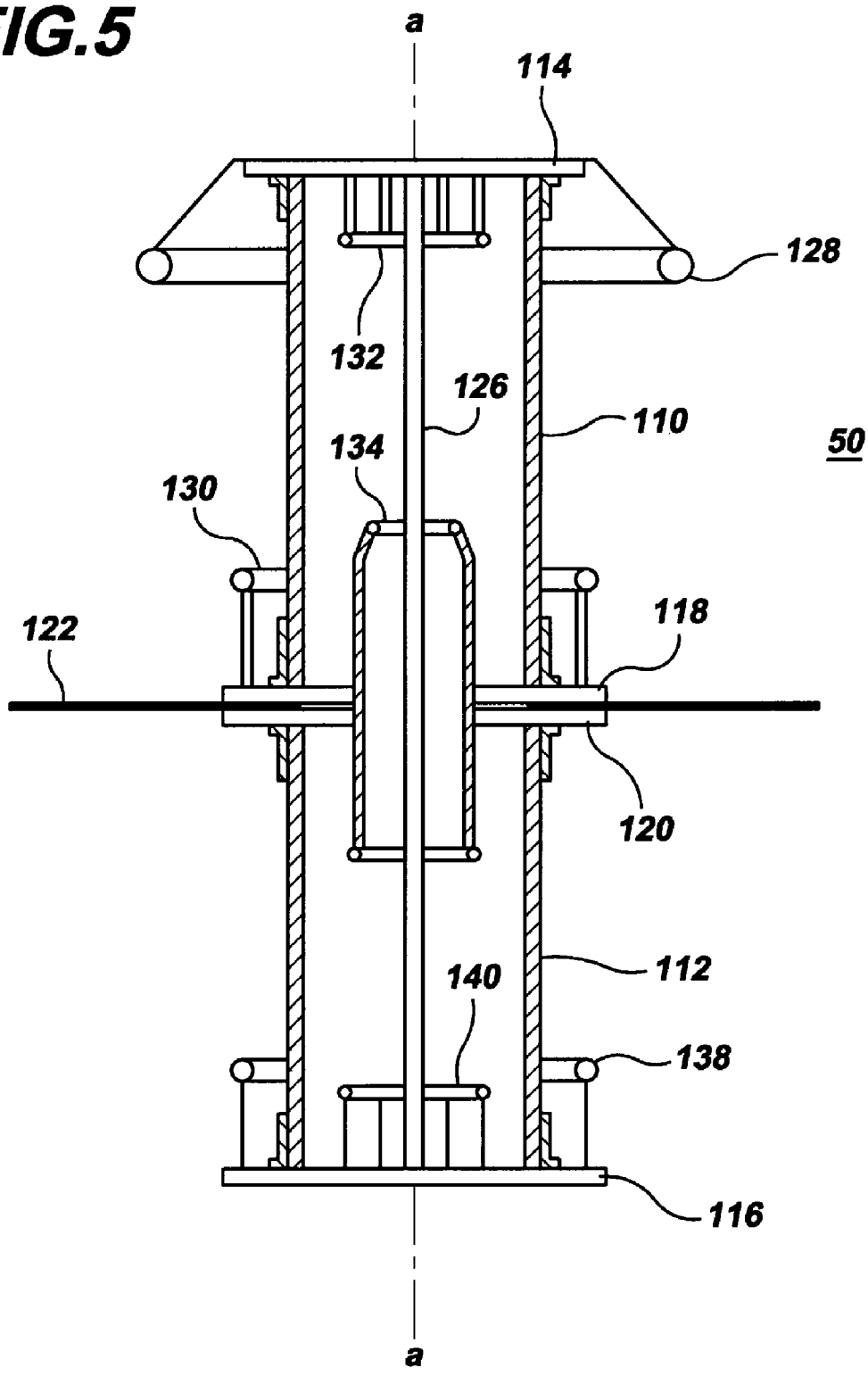
FIG. 5 shows a cross-sectional view of one embodiment of a high-voltage bushing with a specific arrangement of internal and external grading elements.

FIG. 5 shows another embodiment of the HV bushing 100 with a second external corona ring 138 mounted to the second HV end-plate 116 and a second internal grading ring 140 mounted to the second HV end-plate 116. In this embodiment, the second external corona ring 138 is configured to moderate an electric field outside the HV bushing 100 at the junction of the second dielectric tube 112, and the second HV end-plate 116, and the second internal grading ring 140 is configured to moderate an electric field inside the HV bushing 100 at the junction of the second dielectric tube 112, and the second HV end-plate 116.

Figure 6:
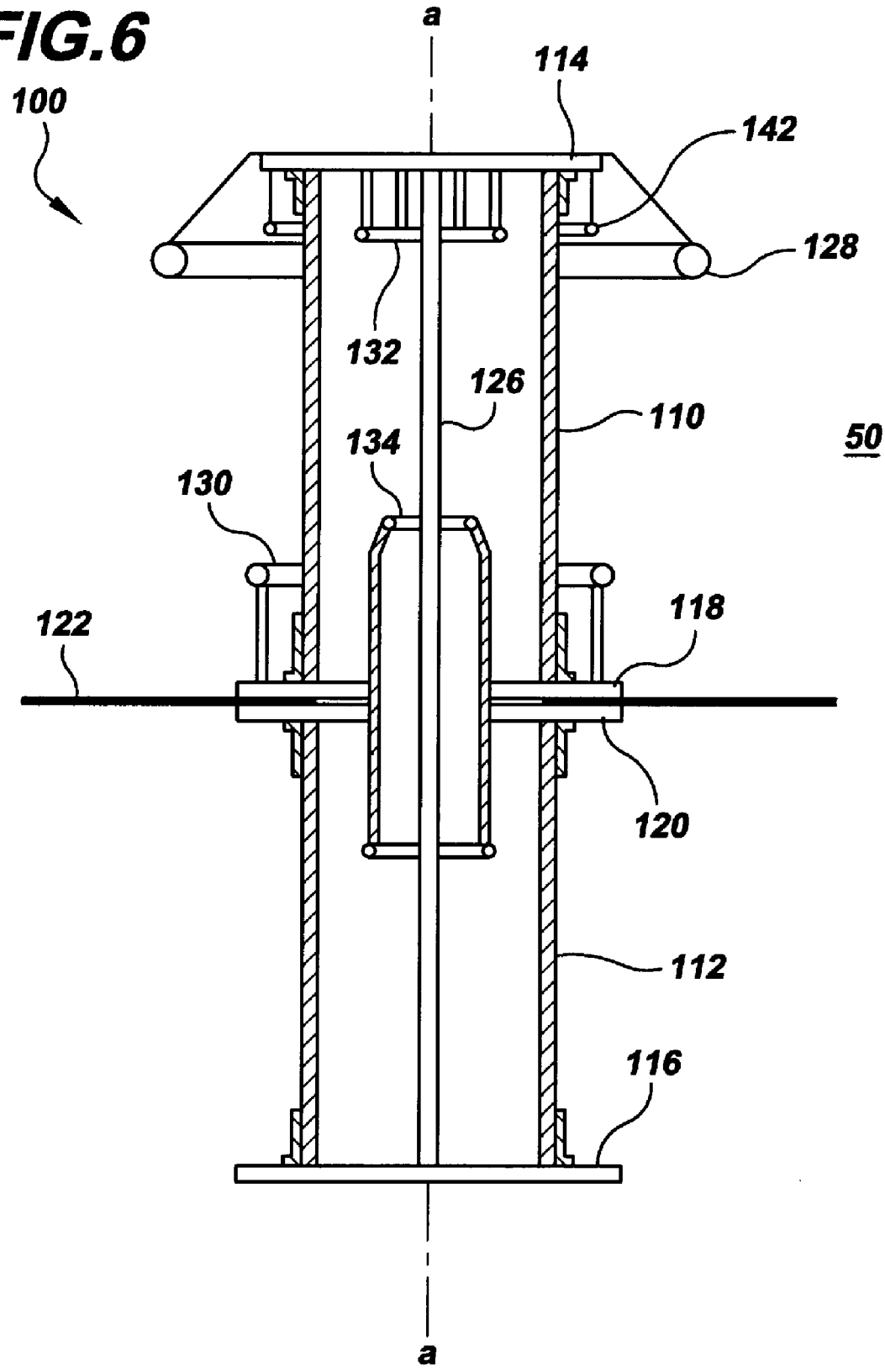
FIG. 6 shows a cross-sectional view of one embodiment of a high-voltage bushing with a specific arrangement of internal and external grading elements.

FIG. 6 shows another embodiment of the HV bushing 100 with a third external corona ring 142 mounted to the first HV end-plate 114. In this embodiment, the third external grading ring 142 is configured to moderate an electric field outside the HV bushing 100 at the junction of the first dielectric tube 110, the first HV end-plate 114, and the open air 50.

Figure 7A:
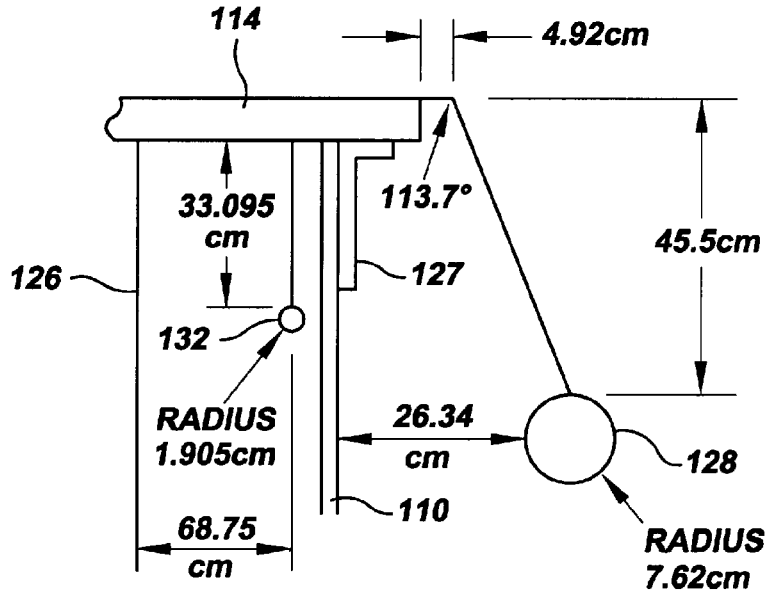
FIG. 7 shows the dimensional relationships of various components of one embodiment of a high-voltage bushing.
Figure 7B:
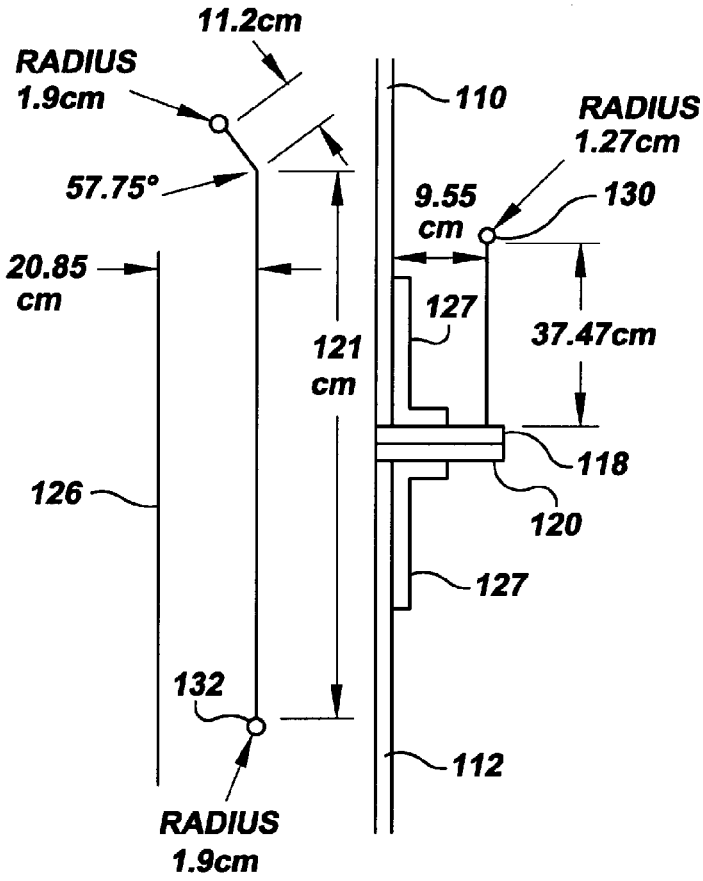

FIGS. 7*a* and 7*b* show an embodiment of the HV bushing 100 with example dimensions. In the embodiment of the HV bushing 100 shown in FIGS. 7*a* and 7*b* the first and second dielectric tubes 110 and 112 have approximate diameters of 76.2 centimeters (30 inches) each and the center conductor 126 has a diameter of approximately 10.16 centimeters (4 inches). Table 1 below, shows electric field results corresponding to the embodiment of the HV bushing 100 with the dimensions disclosed in FIGS. 7*a* and 7*b*.

TABLE 1

| E-field (V/cm) Ground End-Plate | E-Field (V/cm) HV End-Plate | Max E-Field (V/cm) | Location of Max E-Field |
|---|---|---|---|
| $3.47 \times 10^{-3}$ | $3.9 \times 10^{-3}$ | $7 \times 10^{-3}$ | 65 cm from ground end-plate |

Figure 8:
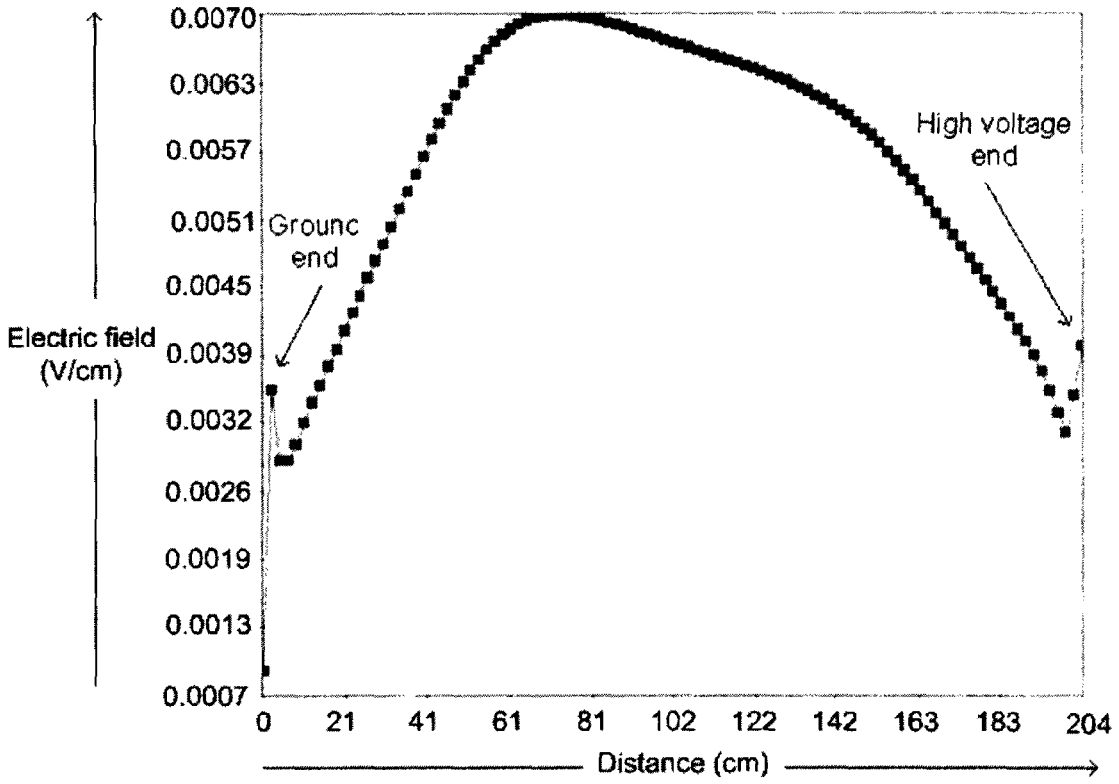
FIG. 8 shows a plot of an electric field verses the distance from a grounded section to a high-voltage section of one embodiment of a high-voltage bushing.

FIG. 8 shows a plot of the electric field along the exterior of the first dielectric tube 110 verses the distance from the first grounded end-plate 118 to the first HV end-plate 114 corresponding to the embodiment of the HV bushing 100 shown in FIGS. 7*a*-7*b*. For the plot shown in FIG. 8, the center conductor 126 has a voltage of 1 per unit.

From the above description of the HV bushing 100, it is manifest that various techniques may be used for implementing the concepts of the HV bushing 100 without departing from the scope of the claims. The described embodiments are to be considered in all respects as illustrative and not restrictive. It should also be understood that HV bushing 100 is not limited to the particular embodiments described herein, but is capable of many embodiments without departing from the scope of the claims.

We claim:

1. A high-voltage (HV) bushing comprising:

first and second sections each having a HV end and a grounded end, wherein the exterior of the first section is configured to be exposed to open air;

at least two internal grading elements, wherein one of the internal grading elements is mounted to the HV end of the first section and one of the internal grading elements is coupled to the grounded end of the first section;

at least two external grading elements, wherein one of the external grading elements is mounted to the HV end of the first section and one of the external grading elements is coupled to the grounded end of the first section; and wherein the internal grading elements and the external grading elements are each configured to moderate an electric field along the inner and outer surfaces of the HV bushing near the HV end and the grounded end of the first section.

2. The HV bushing of claim 1, wherein the first and second sections further comprise:

first and second dielectric tubes respectively;

first and second HV end-plates respectively coupled to the HV ends of the first and second sections;

first and second grounded end-plates respectively coupled to the grounded ends of the first and second sections, wherein the first and second grounded end-plates are configured to be approximately coaxially mounted on opposite sides of a surface, wherein the surface comprises an aperture that is generally coaxial with the first and second dielectric tubes; and wherein the dielectric tubes are configured to enclose a center conductor, wherein the center conductor is generally coaxial with the first and second dielectric tubes.

3. The HV bushing of claim 2, wherein the at least two external grading elements comprise:

an external corona ring mounted to the first HV end-plate, wherein the external corona ring is configured to moderate an electric field outside the HV bushing at the junction of the first dielectric tube, the first HV end-plate, and the open air; and an external grading ring mounted to the first grounded end-plate, wherein the external grading ring is configured to reduce an electric field outside the HV bushing at the junction of the first dielectric tube, the first grounded end-plate, and the open air.

4. The HV bushing of claim 3, wherein the at least two internal grading elements comprise:

an internal grading ring mounted to the first HV end-plate, wherein the internal grading ring is configured to moderate an electric field inside the HV bushing at the junction of the first dielectric tube, and the first HV end-plate; and an electric field shaper mounted inside the HV bushing such that the electric field shaper is configured to moderate an electric field inside the HV bushing at the junction of the first dielectric tube, and the first grounded end-plate.

5. The HV bushing of claim 4, wherein the electric field shaper is mounted within the aperture and is generally cylindrical with open ends and aligned generally coaxially with the first and second dielectric tubes and the center conductor, and wherein the open end of the electric field shaper closest to the first HV end-plate is necked-down so as to moderate the electric field inside the first dielectric tube near the first grounded end-plate.

6. The HV bushing of claim 5, further comprising a shedding affixed to the exterior surface of the first dielectric tube.

7. The HV bushing of claim 5, wherein the dielectric tubes are porcelain.

8. The HV bushing of claim 6, wherein the first and second dielectric tubes are a composite material.

9. The HV bushing of claim 8, wherein the composite material is fiberglass.

10. The HV bushing of claim 6, wherein the shedding is a silicone rubber coating.

11. The HV bushing of claim 6, wherein the first and second dielectric tubes are sealed.

12. The HV bushing of claim 11, wherein the HV bushing is filled with an insulating medium.

13. The HV bushing of claim 12, wherein the insulating medium is nitrogen ($N_2$).

14. The HV bushing of claim 12, wherein the insulating medium is sulfur hexafluoride ($SF_6$).

15. The HV bushing of claim 12, wherein the insulating medium is compressed air.

16. The HV bushing of claim 4, wherein the external corona ring, internal grading ring, electric field shaper, and the external grading ring are made of metal.

17. The HV bushing of claim 4, wherein the internal grading ring is mounted internally with parallel support members to the first HV end-plate.

18. The HV bushing of claim 4, wherein the at least two external grading elements further comprise:

a second external corona ring mounted to the second HV end-plate, wherein the second external corona ring is configured to moderate an electric field outside the HV bushing at the junction of the second dielectric tube, and the second HV end-plate; and wherein the at least two internal grading elements further comprise:

a second internal grading ring mounted to the second HV end-plate, wherein the second internal grading ring is configured to moderate an electric field inside the HV bushing at the junction of the second dielectric tube, and the second HV end-plate.

19. The HV bushing of claim 4, wherein the at least two external grading elements further comprise:

a third external corona ring mounted to the first HV end-plate, wherein the third grading ring is configured to moderate an electric field outside the HV bushing at the junction of the first dielectric tube, the first HV end-plate, and the open air.

20. A high-voltage (HV) bushing comprising:

a first section that comprises:

a HV plate;

a grounded plate;

a dielectric tube coated in silicone rubber and terminated at its ends by terminal flanges, wherein the terminal flanges are mounted to the HV plate and the grounded plate such that the dielectric tube is disposed between the HV plate and the grounded plate;

a grading element mounted inside the dielectric tube to the HV plate;

a grading element mounted inside the dielectric tube to the grounded plate;

a grading element mounted outside the dielectric tube to the HV plate;

a grading element mounted outside the dielectric tube to the grounded plate; and wherein the grading elements are configured to moderate an electric field at the junction of the dielectric tube and the terminal flanges.

* * * * *